US006109725A

United States Patent [19]

Saikawa et al.

[11] Patent Number: 6,109,725

[45] Date of Patent: Aug. 29, 2000

[54] WIPING MECHANISM FOR INK JET RECORDING HEAD AND RECORDING APPARATUS USING SAME

[75] Inventors: Satoshi Saikawa, Inagi; Tetsuo Suzuki, Yokohama; Naoji Otsuka, Kawasaki; Soichi Hiramatsu; Masahiro Taniguro, both of Yokohama; Atsushi Arai, Kawasaki; Hiroyuki Saito, Yokohama; Haruyuki Yanagi, Yokohama; Kentaro Yano, Yokohama; Takashi Nojima, Tokyo; Kiichiro Takahashi; Hiroyuki Kinoshita, both of Kawasaki; Hitoshi Nishikori; Hideaki Kawakami, both of Yokohama; Osamu Iwasaki, Tokyo, all of Japan

[73] Assignee: Canon Kabushiki Kaisha, Tokyo, Japan

[21] Appl. No.: 08/695,549

[22] Filed: Aug. 12, 1996

Related U.S. Application Data

[63] Continuation of application No. 08/096,448, Jul. 26, 1993, abandoned.

[30] Foreign Application Priority Data

Jul. 28, 1992 [JP] Japan ..... 4-201396
Jul. 28, 1992 [JP] Japan ..... 4-201398
Jul. 28, 1992 [JP] Japan ..... 4-201405

[51] Int. Cl.[7] ..... B41J 2/165

[52] U.S. Cl. ..... 347/33

[58] Field of Search ..... 347/22, 23, 33, 347/32

[56] References Cited

U.S. PATENT DOCUMENTS

| | | | |
|---|---|---|---|
| 4,160,982 | 7/1979 | Keur | 347/32 |
| 4,313,124 | 1/1982 | Hara | 346/140 R |
| 4,345,262 | 8/1982 | Shirato et al. | 346/140 R |
| 4,401,990 | 8/1983 | Aiba et al. | 347/33 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 5,097,276 | 3/1992 | Midorikawa | 347/32 |
| 5,153,613 | 10/1992 | Yamaguchi et al. | 346/140 R |
| 5,202,702 | 4/1993 | Terasawa et al. | 347/32 |
| 5,266,974 | 11/1993 | Koitabashi et al. | 347/33 |
| 5,394,178 | 2/1995 | Grange | 347/32 |
| 5,396,277 | 3/1995 | Gast et al. | 347/33 |
| 5,404,158 | 4/1995 | Carlotta et al. | 347/32 |

FOREIGN PATENT DOCUMENTS

| | | | |
|---|---|---|---|
| 0395004 | 10/1990 | European Pat. Off. . | |
| 0465260 | 1/1992 | European Pat. Off. . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 2235761 | 9/1990 | Japan . | |
| 3047754 | 2/1991 | Japan . | |
| 3073352 | 3/1991 | Japan . | |
| 3-246052 | 11/1991 | Japan | 347/33 |
| 3-253347 | 11/1991 | Japan | 347/33 |
| 3274164 | 12/1991 | Japan . | |
| 3281254 | 12/1991 | Japan . | |
| 4090358 | 3/1992 | Japan . | |

*Primary Examiner*—John Barlow
*Assistant Examiner*—Craig A. Hallacher
*Attorney, Agent, or Firm*—Fitzpatrick, Cella, Harper & Scinto

[57] ABSTRACT

A wiping mechanism for wiping an ink ejection side surface of an ink jet head for effecting recording by ejection of ink through ejection outlets includes a wiper for wiping the ejection side surface; and control mechanism for controlling operation of the wiper member in accordance with arrival of a carriage carrying the ink jet head and moving in a predetermined direction.

44 Claims, 15 Drawing Sheets

WIPING MECHANISM FOR INK JET RECORDING HEAD AND RECORDING APPARATUS USING SAME

This application is a continuation of application Ser. No. 08/096,448 filed Jul. 26, 1993, now abandoned.

FIELD OF THE INVENTION AND RELATED ART

The present invention relates to a wiping mechanism for an ink jet recording head and a recording apparatus using same.

A recording apparatus used for an output device for compound electronic machines or work stations including computers and word processors, or a recording apparatus such as a printer, a copying machine, a facsimile machine or the like are designed to effect recording images on a recording material such as sheets of paper or thin resin sheets on the basis of image information. The recording apparatuses are classified into an ink jet type, a wire dot type, a thermal type or a laser beam type, depending on the recording systems.

In a serial type recording apparatus in which a recording head reciprocates in a main scan direction which is substantially perpendicular to the recording material feeding direction (subordinate scan direction), the recording is effected by a recording head mounted on a carriage reciprocable in that direction. After the recording operation is completed for one line, the recording material or sheet is fed by a predetermined distance, and thereafter, the sheet is stopped, and then, the recording is carried out for the next line (main scan). These operations are repeated to cover the entire recording material. On the other hand, in the case of a line type recording apparatus in which only the recording material is fed in the sub-scan direction, the recording material is placed at a predetermined recording position, and the recording for one line is effected all at once, and thereafter, the sheet is fed through a predetermined distance (at a predetermined pitch). Thereafter, the next line recording is carried out again. These operations are repeated to effect the recording all over the recording material.

In an ink jet recording apparatus, the ink is ejected from a recording means (recording head) onto the recording material. It is advantageous in that the size of the recording material can be easily reduced, that fine images can be recorded at a high speed, that the recording is possible on plain paper without special treatment, that the running cost is low; that it is non-impact type, and therefore, the noise is small, that it is easy to effect color image recording using different color inks. Among the ink jet type recording machines, a line type apparatus using a line recording means having a number of ejection outlets arranged in a direction of a width of the recording material, is advantageous because a further high speed recording is possible.

Particularly, an ink jet recording means using thermal energy is advantageous in that the size can be further reduced because the recording means (recording head) can be easily produced at high density of ejection outlets by forming electrothermal transducers, electrodes and liquid passage walls on a substrate, and forming a top plate through a semiconductor manufacturing process including etching, evaporation and sputtering processes. On the other hand, the demands are expanded for the recording material, more particularly, for a thinner sheet, processed sheets (punched sheets, perforated sheets or no rectangular sheets, as well as the thermal recording sheet of paper or thin resin sheet (OHP).

In the ink jet recording apparatus, the ink ejection side surface of the recording head may be contaminated by paper dust or other dust or the like or with ink. In that case, the ejected ink may be deflected, or the ejection outlet may be clogged, with the possible result of improper ink ejection. In order to prevent the improper ink ejection, it is desired that the ink ejection side surface of the recording head is periodically cleaned. In order to accomplish this, the dust or the ink deposited on the ejection side surface is conventionally removed by an edge of a plate member of rubber or another elastic material.

Referring to FIGS. 6 and 7, an example thereof will first be described. FIG. 6 is a perspective view of a conventional ink jet apparatus.

A recording head 101 for recording an image on a recording material 105 by ejection of the ink through an ejection outlet of the ink ejection side surface 101*a*, is carried on a carriage 102. The carriage 102 is supported on a guiding shaft 103 and is reciprocated in faced relation with the recording material 105. The recording material 105 is press-contacted to a feed roller by a pinch roller, so that the recording material is fed by rotation of the feed roller. After the image formation, the recording material 105 is discharged to the outside of the recording apparatus by discharging rollers. The pinch roller, the feed roller and the discharging rollers are not shown in the Figure. The foreign matter or residual ink on the ejection side surface 101*a* are removed by a wiper 104 disposed outside the image forming area. A cap 106 is provided in order to prevent clogging of the ejection outlet and suck the ink from the recording head, while covering the ejection side surface 101*a*. The conventional method of cleaning (wiping) to remove the foreign matter and the ink from the ejection side surface 101*a* uses a wiper 104.

FIG. 7 schematically shows the wiping operation, in which the wiper is not operated (a), is in the operation (b), and has been completed (c). Designated by reference numeral 105 is ink scattered by the wiper; and x1 indicates the position of the ejection outlet.

When the carriage 102 moves in a direction A, the recording head 101 also moves in the same direction. With the movement of the recording head 101, the upper part of the wiper 104 is urged in the lateral direction to be bent, so that the end thereof is press-contacted to the ejection side surface 101*a* with proper pressure. The recording head 1 is further moved while this state is maintained, and therefore, the ink or the foreign matter deposited on the ejection side surface 101*a* are scraped off by the wiper 104. After it moves completely through the recording range, the wiper 104 restores the original shape by the elasticity.

By the series of wiping operations described above, the ink ejection side surface 101*a* is cleaned, so that the ink ejection is stabilized, and the proper images can be provided.

When the structure of FIG. 6 is used, the ejection side surface is wiped during the forward and backward movements of the carriage 102. This is not advantageous from the standpoint of the durabilities of the recording head 101 and the wiper 104.

When the shape of the wiper 104 restores as shown in (c) of FIG. 7, the ink or the like now deposited on the wiper 104 may scatter. In the case of the reciprocating wiping operations, either one of the scattering directions is toward the recording material, and therefore, the image may be contaminated.

In the conventional wiping mechanism in the ink jet recording apparatus, use is made of a motor exclusively for a sucking recovery device. This requires the driving source dedicated to the wiping mechanism, and a transmission mechanism is additionally required for the wiping mechanism. These limit the size reduction of the ink jet recording apparatus.

SUMMARY OF THE INVENTION

Accordingly, it is a principal object of the present invention to provide a wiping mechanism and an ink jet recording apparatus using the wiping mechanism, and a wiping method in which the ink ejection side surface can be cleaned assuredly.

It is a further object of the present invention to provide a wiping mechanism, an ink jet recording apparatus using the wiping mechanism, and a wiping method in which the wiping operation can be assuredly performed with simple structure without use of driving source addicted thereto.

It is a further object of the present invention to provide a wiping mechanism, an ink jet recording apparatus using the wiping mechanism and a wiping method in which a one-way wiping operation can be assuredly performed with simple structure, and the size of the recording apparatus can be reduced.

It is a yet further object of the present invention to provide a wiping mechanism, an ink jet recording apparatus using the wiping mechanism and a wiping method in which a wiping mechanism is operated by movement of the carriage, so that the size of the recording apparatus can be further reduced.

According to an aspect of the present invention, there is provided a wiping mechanism for wiping an ink ejection side surface of an ink jet head for effecting recording by ejection of ink through ejection outlets, comprising: a wiper for wiping the ejection side surface; and control mechanism for controlling operation of said wiper member in accordance with arrival of a carriage carrying the ink jet head and moving in a predetermined direction.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
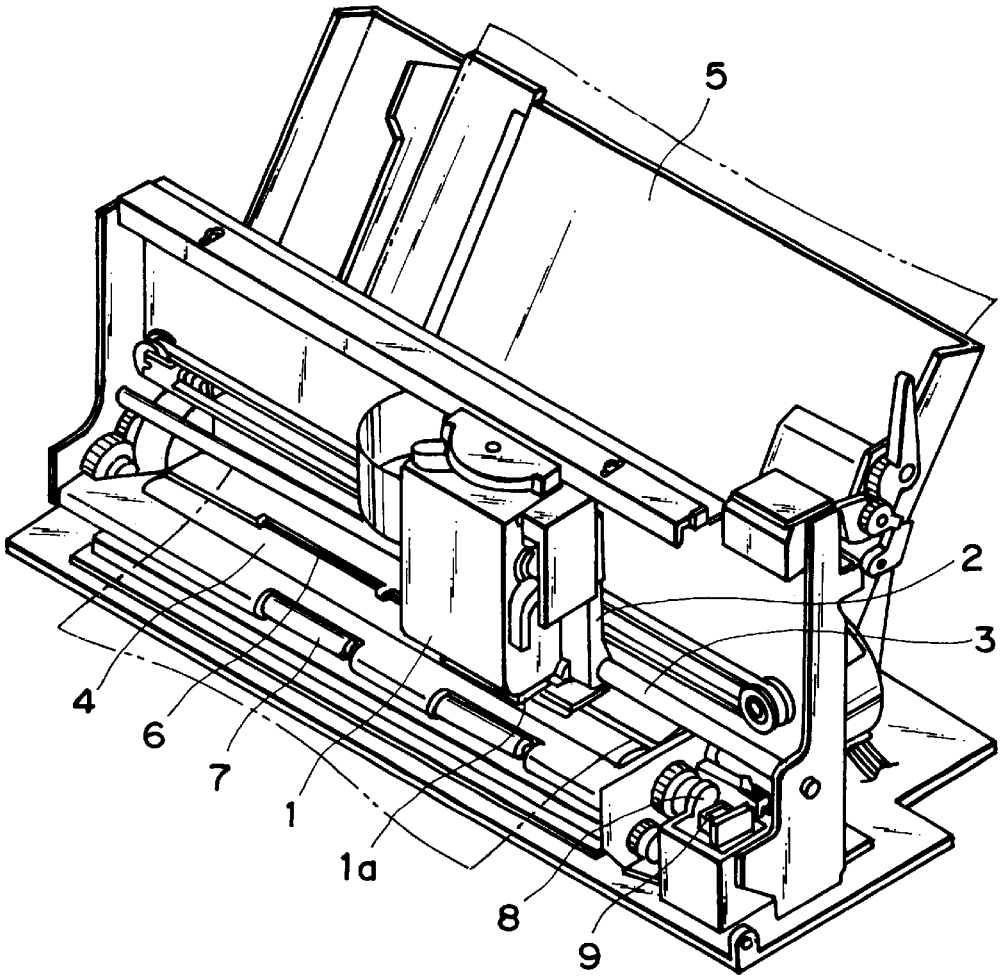
FIG. 1 is a perspective view of a major part of an ink jet recording apparatus according to an embodiment of the present invention.

FIG. 1 is a perspective view of an ink jet recording apparatus according to an embodiment of the present invention.

A recording head for effecting recording on a recording material 5 by ejection of ink through ejection outlets of an ink ejection side surface 1*a* is carried on a carriage, and the carriage 2 is supported on a guiding shaft 3 for reciprocation in faced relation with the recording material. The recording material 6 is press-contacted to a feed roller 4 by a pinch roller 6, and the recording material is fed by rotation of the feed roller 4. The recording material 5, after the image forming operation, is discharged to an outside of the recording apparatus by discharging rollers 7.

Residual ink or foreign matter such as paper dust deposited on the ink ejection side surface 1*a* is removed therefrom by a wiper 8 disposed outside an image formation region. A cap 9 is provided to prevent clogging of the ejection outlets and to suck the ink from the outside of the recording head, while capping ejection side surface 1*a*.

The recording head is in the form of an ink jet recording means for ejecting the ink using thermal energy. Therefore, it is provided with electrothermal transducers for producing thermal energy. The recording head 1 functions to eject the ink through the ejection outlets by pressure change caused by the expansion and contraction of a bubble produced by film boiling by the thermal energy applies from the electrothermal transducer.

Figure 5:
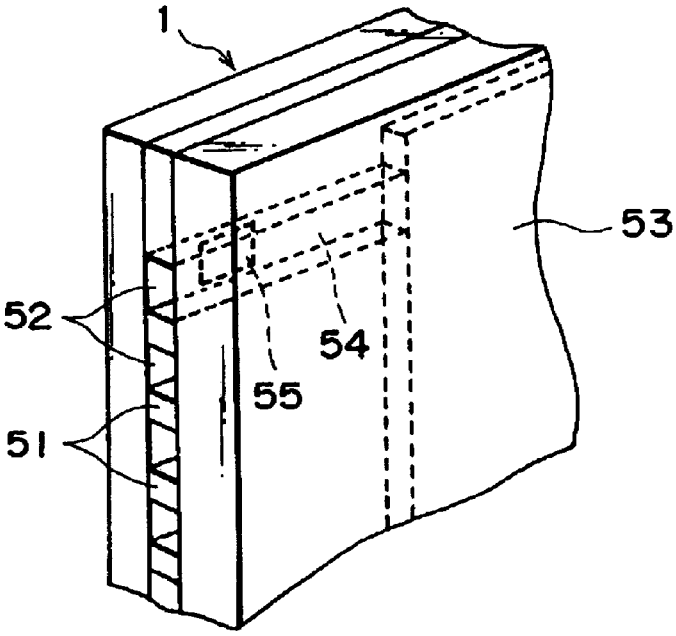
FIG. 5 is a partial perspective view of an ink ejection outlet of a recording head used in the apparatus of FIG. 1.
Figure 6:
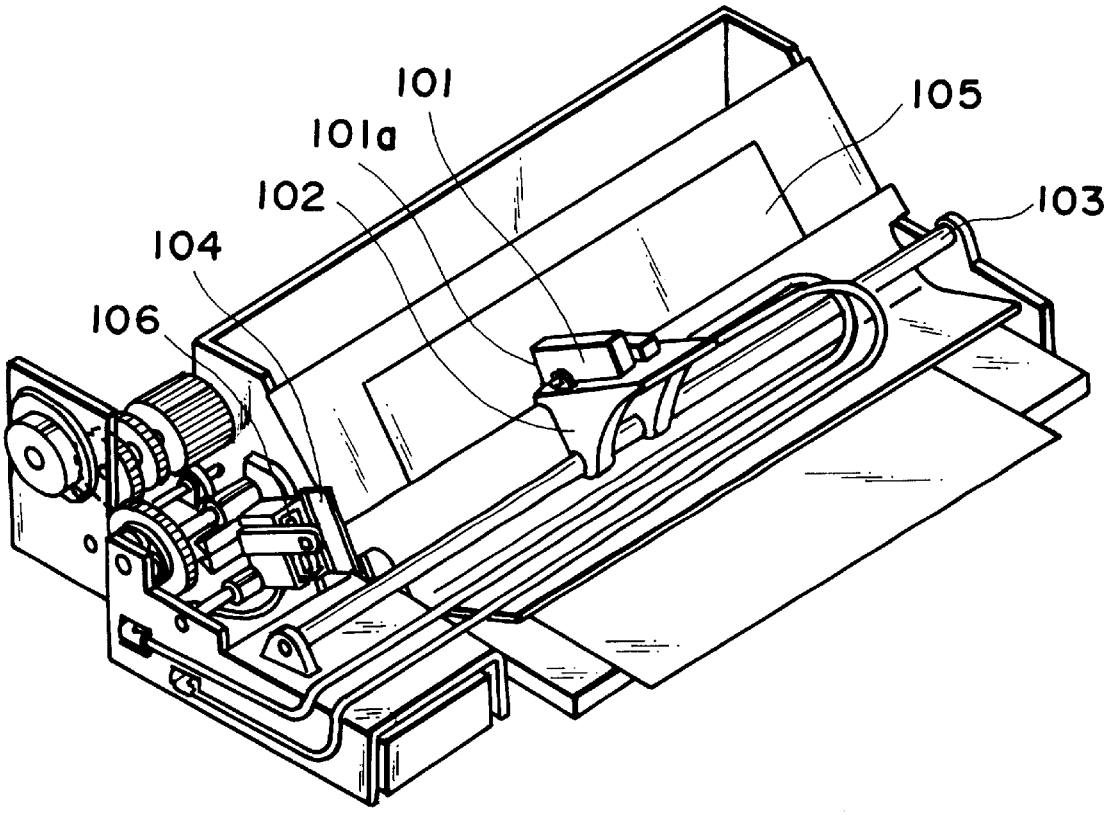
FIG. 6 is a schematic perspective view of a major part of a conventional ink jet recording apparatus.
Figure 7:
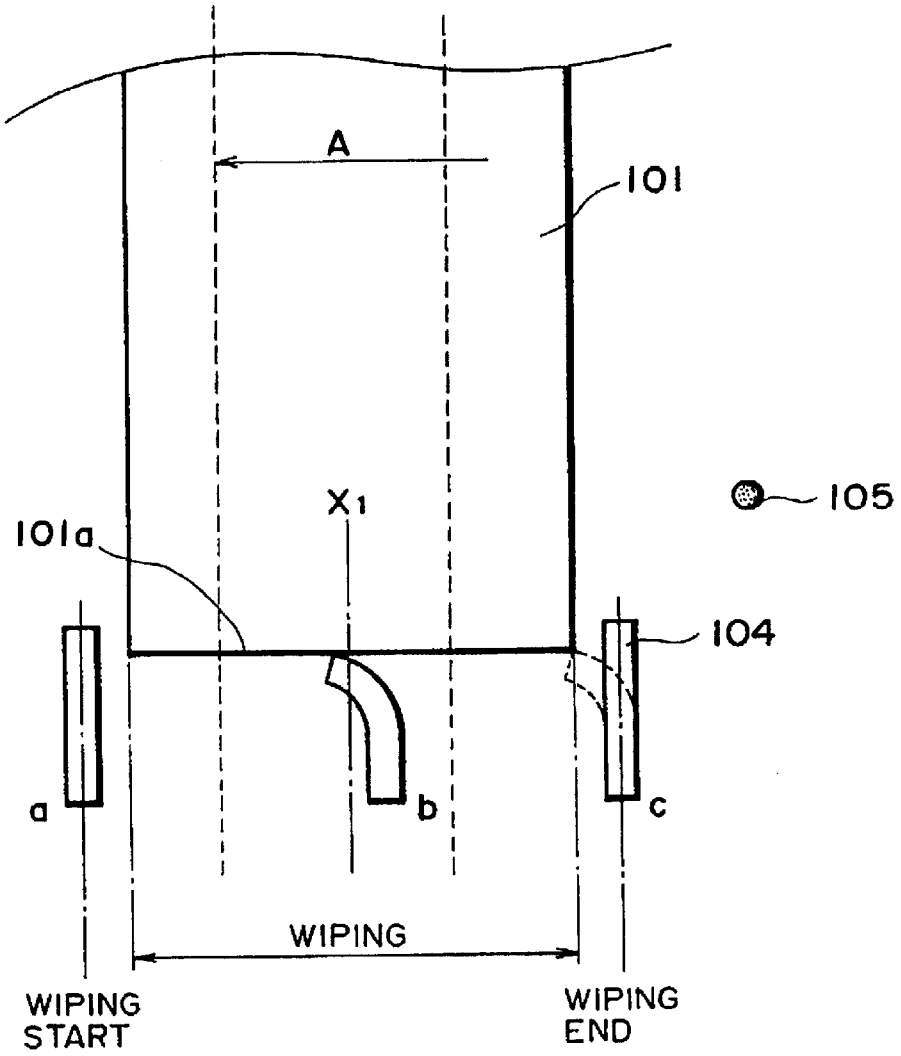
FIG. 7 illustrates a wiping operation.

Referring to FIG. 5, there is shown a structure of the ink ejection part of the recording means (recording head) 1. In this Figure, a plurality of ejection outlets 52 are formed at predetermined intervals in an ejection side surface 51 which is to be faced to a recording material with a predetermined gap therebetween (approx. 0.5–2.0 mm, for example). An electrothermal transducer (heat generating resistor or the like) 55 for producing the ink ejecting thermal energy is disposed along a wall of each of liquid passages 54 for communication between a common liquid chamber 53 and the ejection outlets 52. In this example, the recording head 1 is carried on a carriage 2 with such a positional relation that the ejection outlets 52 are arranged in a direction crossing with the scanning direction of the carriage 2. In this manner, in response to the image signal or ejection instructing signal, the associated electrothermal transducer 5 is driven (energized), to produce the film boiling in the ink in the passage 54, thus producing pressure to eject the ink through the ejection outlet 52.

In this example, the ink jet recording apparatus is a monochromatic ink jet recording apparatus having one recording head 1 on the carriage 2. The present invention is applicable to a color recording ink jet apparatus using a plurality of recording heads for different colors, or to a tone gradation ink jet recording apparatus using a plurality of recording heads to effecting recording with different density with the same color, irrespective of the number of recording heads.

The recording head 1 may be in the form of a recording head cartridge having integral recording head and ink container, or a separate type in which separate recording head and ink container are used with ink supply tube connecting therebetween, irrespective of the structure of the recording means and ink container.

Figure 2:
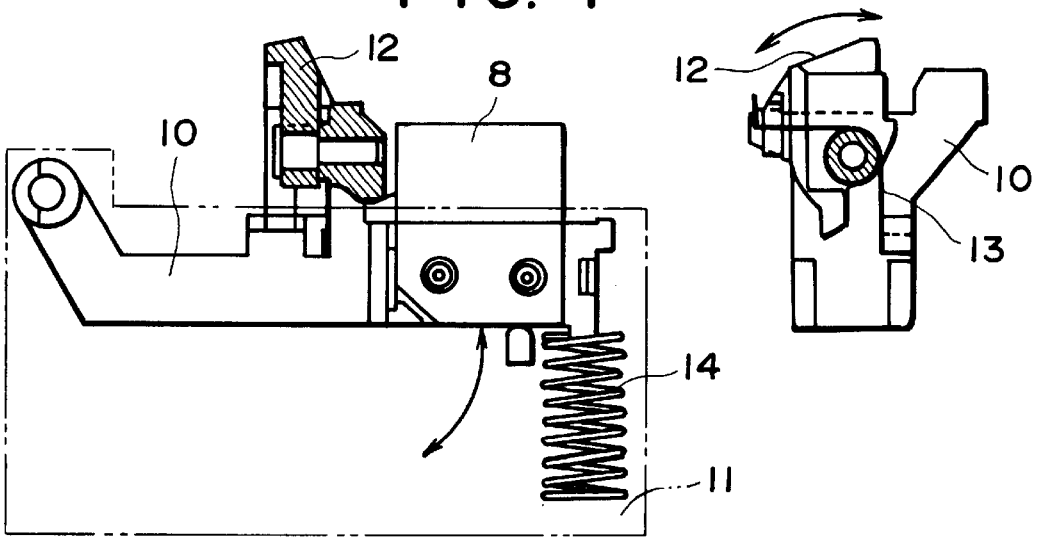
FIG. 2 is a sectional view of a major part of a wiping mechanism of the ink jet recording apparatus of FIG. 1.
Figure 3A:
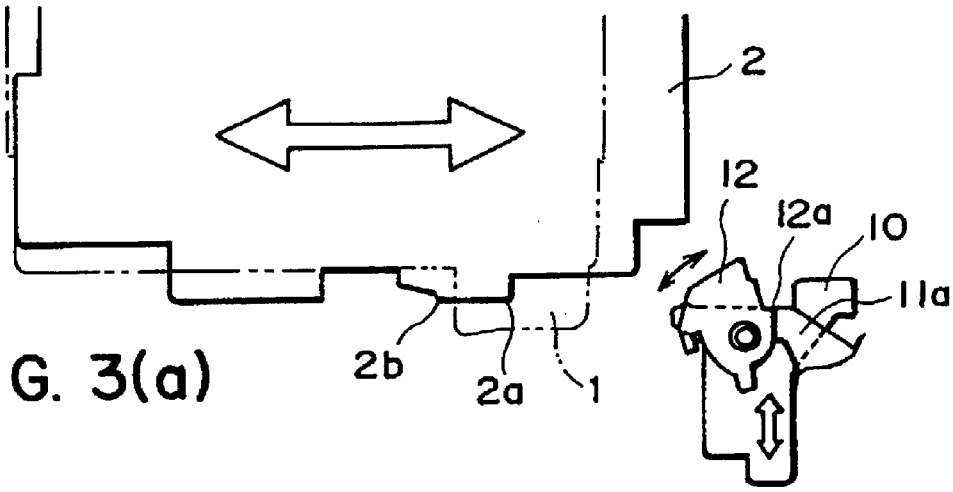
FIGS. 3(*a*) to 3(*d*) illustrate to operation of the wiping mechanism of FIG. 2.
Figure 3B:
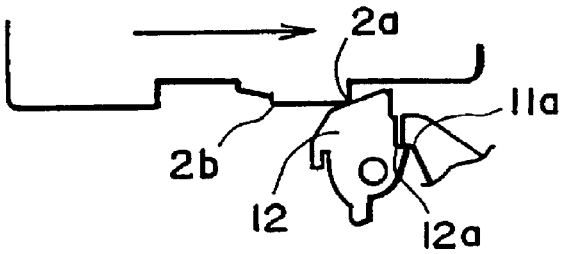
Figure 3C:
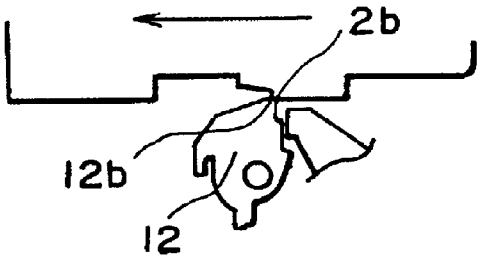
Figure 3D:
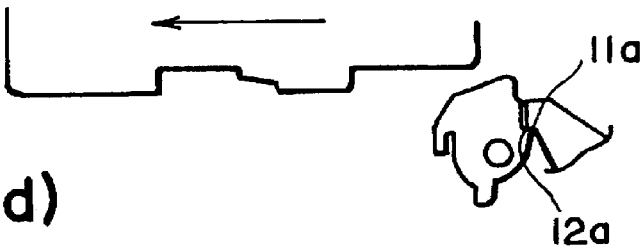
Figure 4A:
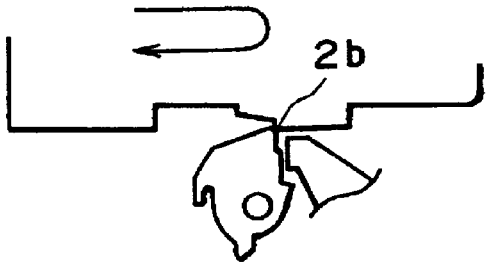
FIGS. 4(*a*) and 4(*b*) illustrate an operation of a wiping mechanism of FIG. 2.
Figure 4B:
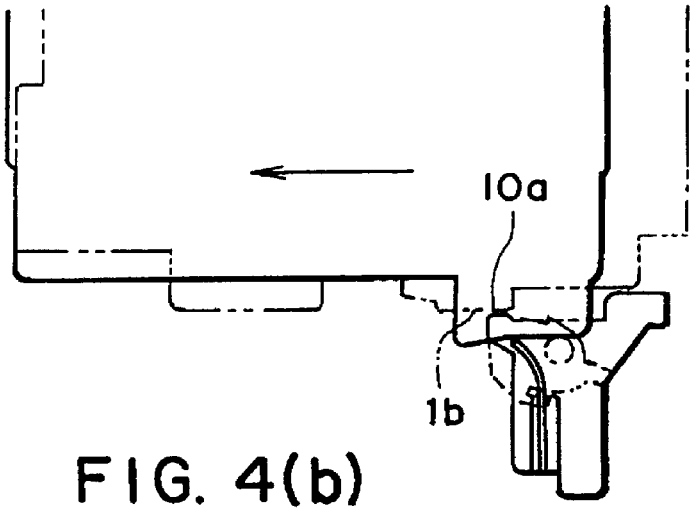

FIG. 2 illustrates the major part of the wiping mechanism of the ink jet recording apparatus of FIG. 2. FIGS. 3 and 4 illustrates operation thereof.

The wiper 8 is fixed on a wiper holder 10, which is in turn mounted for vertical swinging movement on a base 11 at its one end. A latch cam 12 is mounted for horizontal swinging movement on the wiper holder 10, and it is urged in one direction by a latch spring 13. These components comprise a mechanism for changing the position of the wiper between a wiping position and a non-wiping position relative to the head, as discussed below.

The wiper holder 10 is urged upwardly by a wiper spring 14, so that the wiper is in its operative state when the wiper 8 is in the moving path of the recording head 1. In FIG. 3(*a*), the movement of the carriage and the movements of the latch cam and the base are schematically shown.

At the bottom of the carriage 2, a stepwise cam is formed, and when the carriage 2 moves from the left to the right, a portion 2*a* abuts the inclined surface of the latch cam 12 to press the latch cam 12 down. Then, the wiper 8 is depressed through the wiper holder 10, and therefore, the wiper 8 is retracted from the moving path of the recording head (FIG. 3(*b*)). At this time, the latch portion 12*a* of the latch cam 12 is brought into engagement with a hook 11*a* integral with the base 11 so that the wiper 8 is maintained at the depressed position. If the moving direction is reversed (FIG. 3(*c*)) before the cam portion 2*b* reaches the end portion 12*b* of the latch cam 12, the wiper 8 is maintained at the retracted position (FIG. 3(*d*)). The image recording operation is carried out in this state.

The description will be made as to the wiping operation. The carriage 2 is moved to the right from the position indicated in FIG. 3(*c*). At this time, the wiper 8 is still in the retracted position. When the reversing is carried out after the cam portion 2*b* of the carriage 2 has passed by the end 12*b* of the latch cam 12 (FIG. 4(*a*)), the cam portion 2*b* of the carriage 2 pushes the latch cam 12, so that the engagement between the latch portion 12*a*, and the hook portion 11*a* is released. Then, the spring force of the wiper spring 14 pushes the wiper holder 10 upwardly into the path of the recording head 1, so that the wiper 8 is placed in the operative state. At this time, the entering amount regulating portion 10*a* which is integral with the wiper holder 10 is in contact with a wiping reference surface 1*b* of the recording head, by which the entering amount or distance of the wiper 8 relative to the ink ejection side surface 1*a* is maintained properly.

Figure 8A:
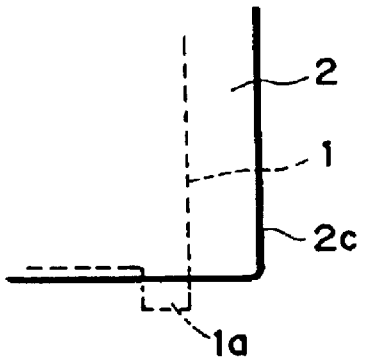
FIGS. 8(*a*) and 8(*b*) a capping operation.
Figure 8B:
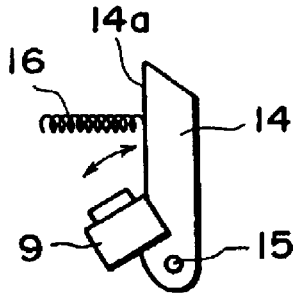

A capping operation of the recording head 1 will be described. The carriage 2 carrying the recording head 1 is moved further to the right beyond the end portion 12*b* of the latch cam 12 by the carriage cam 2*b*. As described above, the wiper is in the retracted position. In FIG. 8, a side surface 2*c* of the carriage 2 pushes to the right a side surface 14*a* of a cap displacing lever 14 urged to the left by a spring member 16 mounted between the cap displacing lever 14 and a frame of the main assembly of the recording apparatus. The cap displacing lever 14 rotates in the clockwise direction about an axis 15. The cap 9 which is open toward the carriage is deflected upwardly by rotation of the cap displacing lever 14. Then, it is contacted to the ejection side surface 1*a* of the recording head 1 to cap it. Using the force moving the carriage 2, the ejection side surface 1*a* is capped, and therefore, there is no need for a driving source for moving the cap 9. The description will be made as to the motion from the capping state to the recording state. When the carriage 2 moves to the left from the capping position, the cam portion 2*b* depresses the latch cam 12, as described above to release the engagement between the latching portion 12*a* and the hook 11*a* to place the wiper 8 into the operating state. After the wiping of the ejection side surface 1*a* by the wiper 8, the carriage 2 is moved further to the left into the state shown in FIG. 3(*a*). At this time, the wiper 8 remains pushed up. However, with this state, the serial printing motion of the carriage 2 is obstructed. Therefore, the carriage 2 is once moved to the right into the state shown in FIG. 3(*c*), so that the wiper 8 is maintained in the retracted state. With this state, the image recording operation is carried out.

As described in the foregoing, the wiping operation is carried out only when the carriage 2 moves to the left. Therefore, the wiper 8 is bent to the left (FIG. 4(*b*)), and therefore, the ink drops scattered by the spring-back of the wiper 8 immediately after the wiping operation are always directed to the right. Therefore, the ink does not scatter into the image formation region at the left of the wiping mechanism, by which the contamination of the recording material can be avoided.

The description will be made as to the wiping operation usable with the above-described embodiment.

EXAMPLE 1

Figure 9:
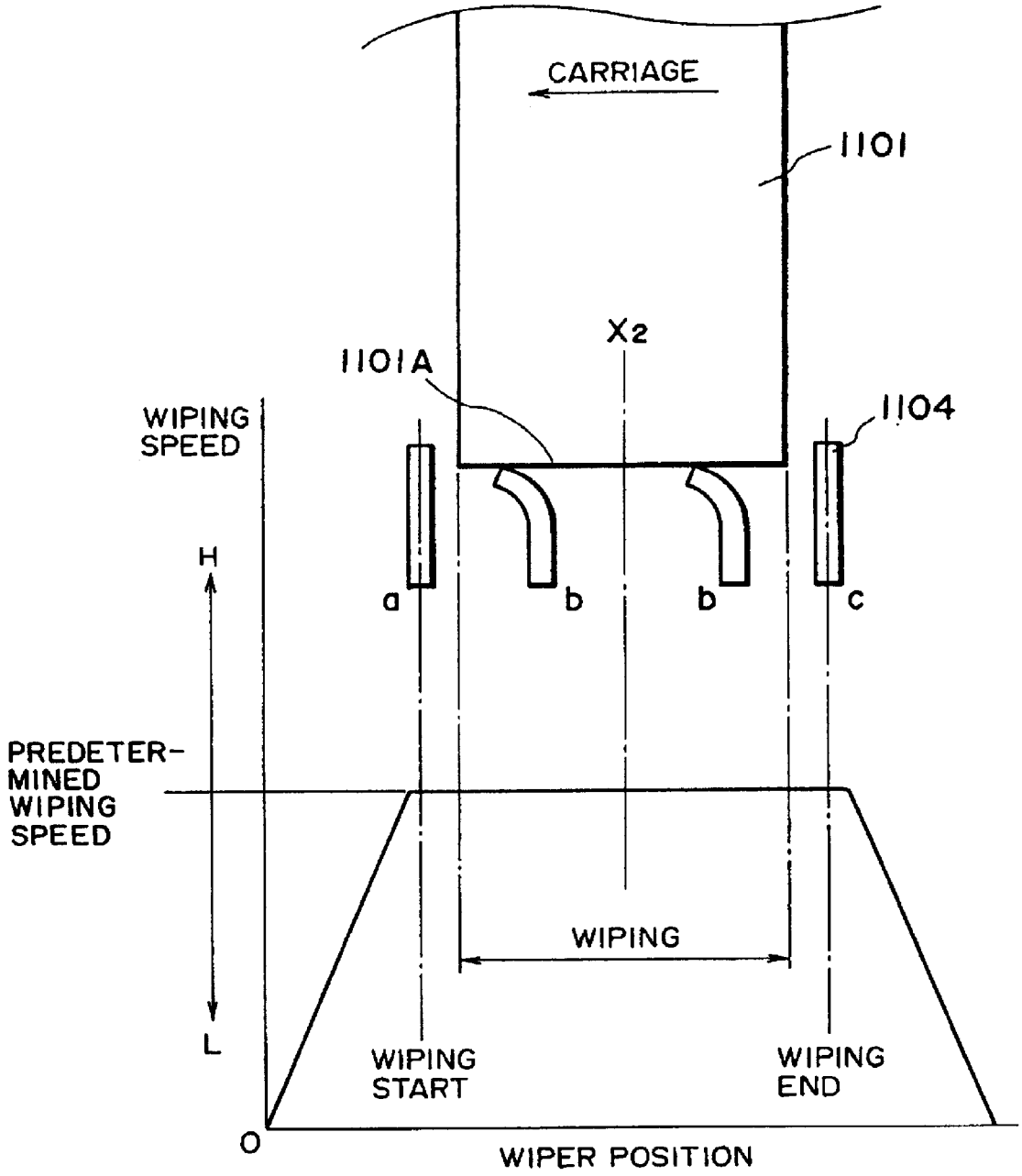
FIG. 9 illustrates a first example.

This is shown in FIG. 9, in which the speed of a wiper 1104 is always constant when it wipes the recording head face 1101*a* of the recording head 1101. The shapes of the wiper 1104 are indicated by (a), (b) and (c), which are for before wiping operation, during wiping operation and after wiping operation, respectively. Designated by X2 is the position of the ejection outlet.

EXAMPLE 2

Figure 10:
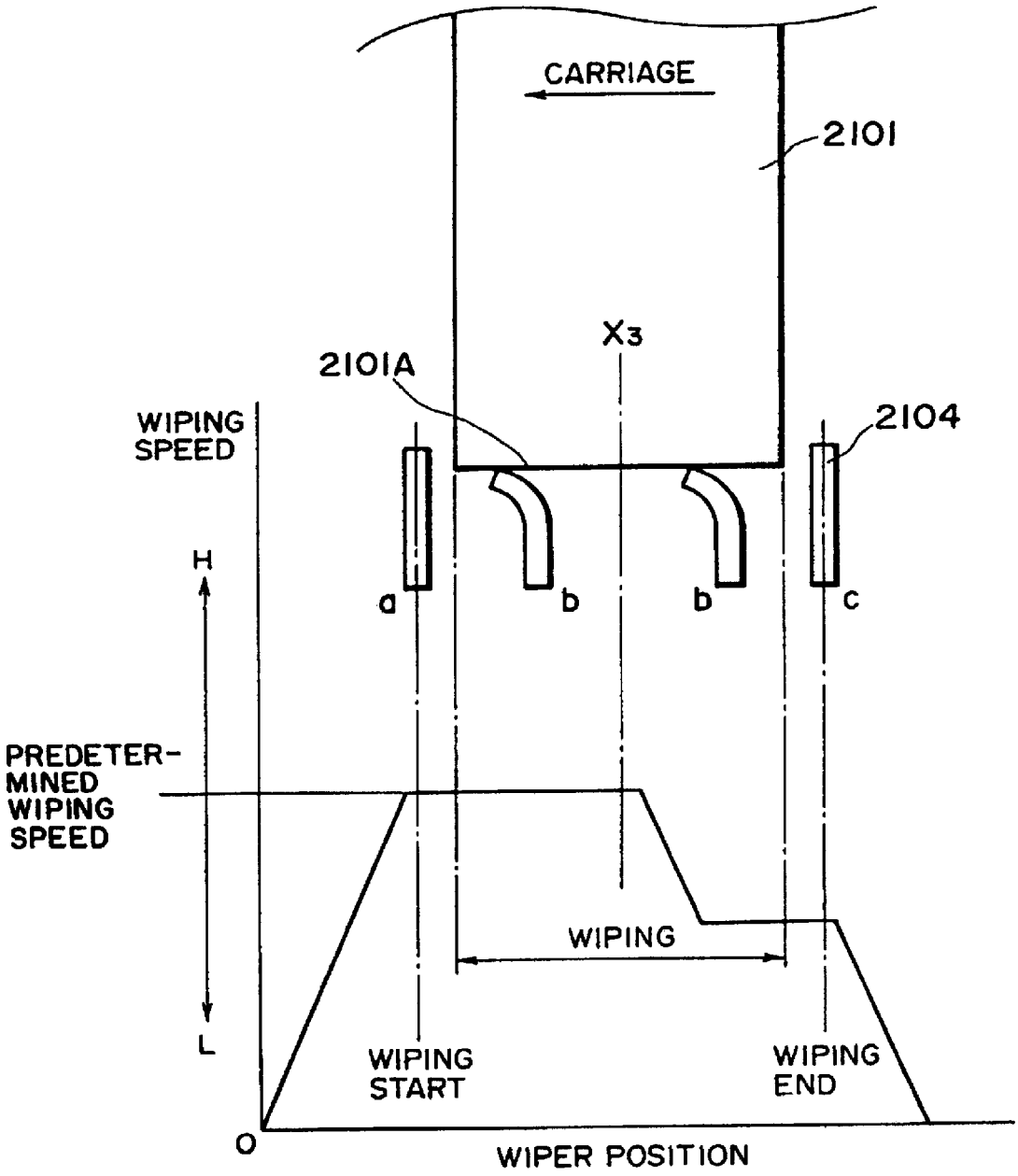
FIG. 10 illustrates a second example.

FIG. 10 shows Example 2 in which the wiping operation is carried out at a constant speed to a position in the neighborhood of the ejection outlet, and then, the wiping speed is reduced. When the wiper departs the head face 2101A of the head 2101 to return the original position, the speed is minimum. By doing so, the scattering of the ink removed from the head face 2101A can be prevented or minimized, thus preventing contamination of the recording apparatus with the ink.

In the Figure, (a), (b) and (c) designate the shapes of the wiper 2104, before the wiping operation, during the wiping operation and after the wiping operation, respectively. Designated by X3 is a position of the ejection outlet.

EXAMPLE 3

Figure 11:
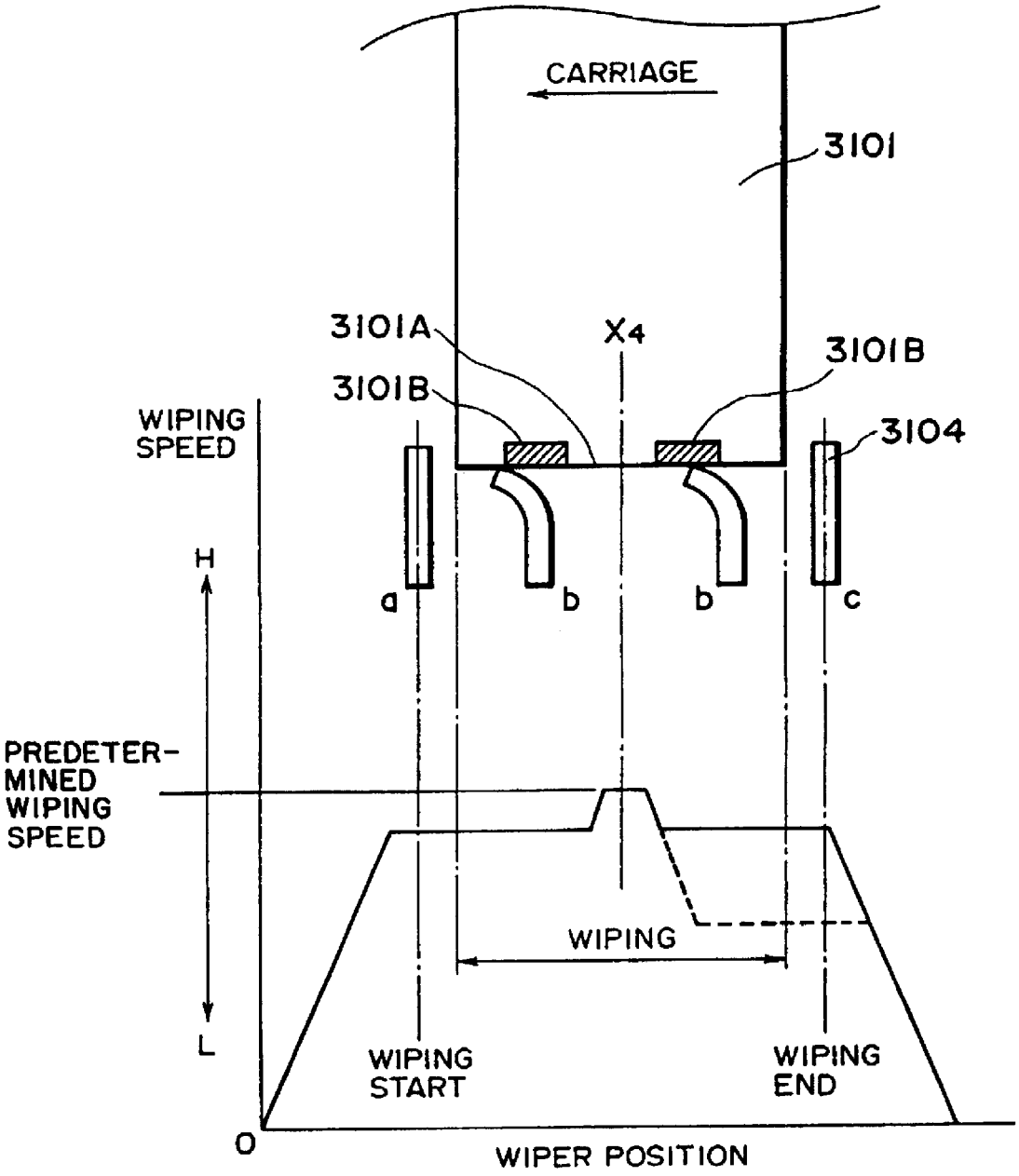
FIG. 11 illustrates a third example.
Figure 12:
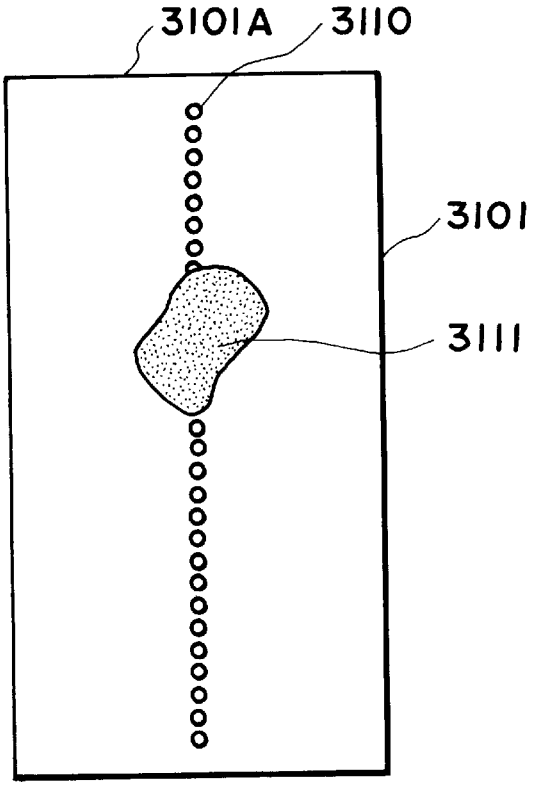
FIG. 12 shows a face of a recording head of the recording apparatus.
Figure 13:
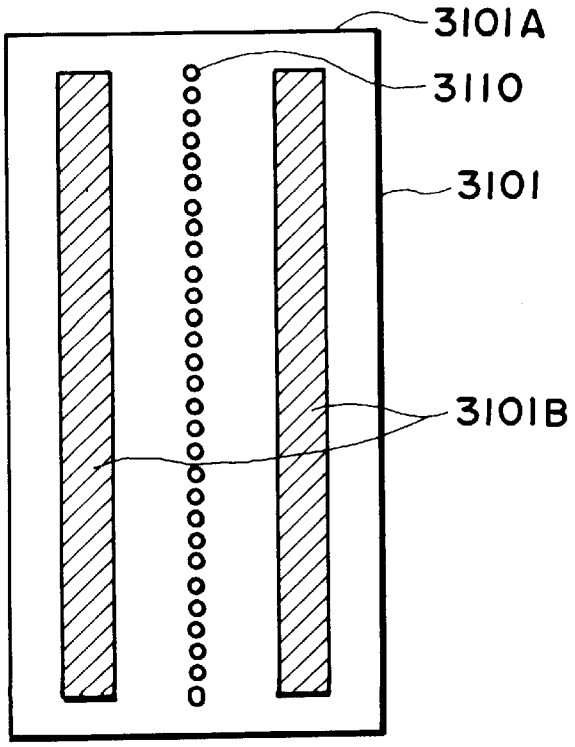
FIG. 13 illustrates a face of a recording head of the recording apparatus.

Referring to FIGS. 11, 12 and 13, the description will be made as to Example 3. The wiping operation is carried out for the purpose of removing the foreign matter such as paper dust deposited on the head face 3101A of the recording head 3101 and also for the purpose of removing the ink deposited on the head face 3101A. The ink may be deposited on the head face 3101A because of the scattering of a part of the ejected ink adjacent the nozzle or because of the ink rebound from the surface of the sheet. When the ink is deposited to cover the nozzle, as shown in FIG. 12. The ink droplet ejected through that nozzle does not travel in the right direction with the result of improper image formation. In this Figure, (a), (b) and (c) indicate the shapes of the wiper 3104 before the wiping operation, during the wiping operation and after the wiping operation, respectively. X4 indicates the position of the ejection outlet.

It is considered that, as shown in FIG. 13, a hydrophilic portion 3101B effective to attract the ink 3111 at both sides of the nozzle line 3110 of the head interface 3101A, and the ink is accumulated onto the hydrophilic portion 3101B, thus preventing accumulation of the ink 3111 on the nozzle line 3110.

Referring to FIG. 11, an embodiment using the hydrophilic portion 3101B will be described.

In this embodiment, a predetermined constant speed wiping operation is carried out only in the neighborhood of the ejection outlets, and at both sides thereof having the hydrophilic portions 3110B, the wiping speed is decreased in order to sufficiently remove the ink stagnated there. By the combination with the above-described Example 2, the wiping speed profile indicated by the broken line is effective to prevent the scattering of the removed ink.

EXAMPLE 4

Figure 14:
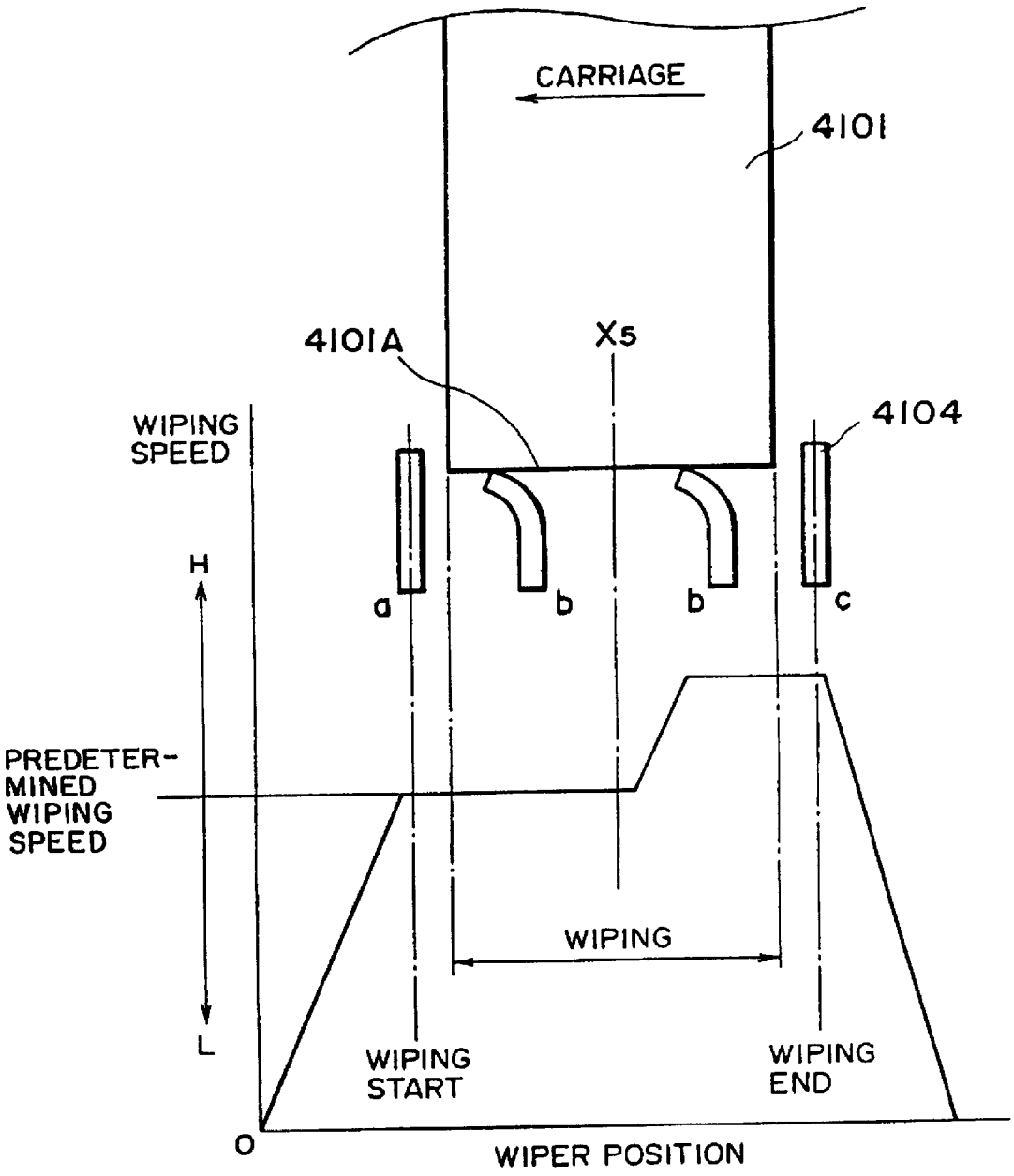
FIG. 14 illustrates a fourth example.
Figure 15:
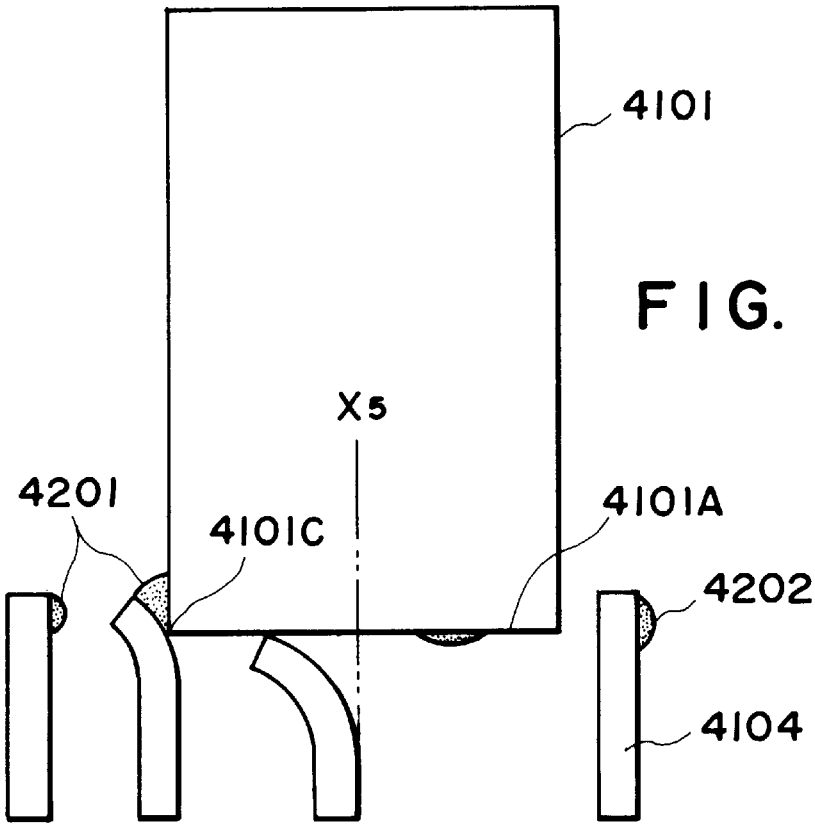
FIG. 15 illustrates a wiper cleaning in the fourth example.
Figure 16:
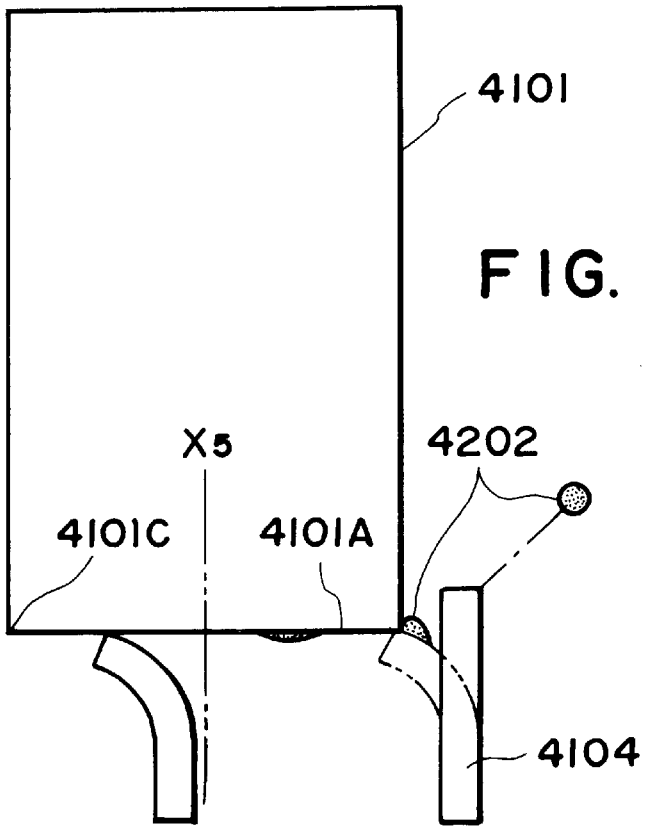
FIG. 16 shows the wiper cleaning in the fourth example.

Referring to FIGS. 14, 15 and 16, an Example 4 will be described. In Examples 1–3, a part of the ink removed by the wiper 4104 is deposited on the wiper 4104. If the ink is dried and the viscosity thereof is increased, the wiping performance of the wiper itself 4104 decreases. The ink having the high viscosity is deposited on the nozzle of the head face 4101A with the possible result of clogging of the nozzles. Therefore, in Examples 1–3, in order to remove the ink deposited on the wiper 4104, a head edge 4101*c* is contacted to the wiper 4104 as shown in FIG. 15, thus removing the deposited ink. However, when this wiper mechanism is not able to take, there is a possibility that a separate wiper cleaning mechanism is used. However, it would result in increase of the number of parts and therefore the cost. This can be avoided by use of this Example. In the Figure, (a), (b) and (c) indicate the shapes of the wiper 4104 before, during and after the wiping operation, respectively. Indicated by X5 is the position of the ejection outlet. The ink already wiped out is indicated by 4201, and ink 4202 is the ink removed in this process.

As shown in FIG. 14, adjacent the ejection outlet line, as described hereinbefore, the constant predetermined speed wiping operation is carried out. When the wiper 4104 passes the nozzle, the speed is increased, and the wiping operation is completed at the maximum speed. By doing so, the ink deposited on the wiper 4104 is scattered strongly as shown in FIG. 16. Therefore, the ink deposited on the wiper is removed. In this manner, this example is usable in the case where there is no wiper cleaning mechanism. The scattered ink can be received by an ink receptor. The ink receptor will be described hereinafter.

As described in the foregoing, according to the above-described examples, the wiping speed is constant adjacent the ejection outlet portion during the wiping operation, and the wiping speed is changed in the other region. Therefore, the wiping speed is constant in the ejection outlet disposed region, and the cleaning operation can be carried out with the same cleaning conditions at the start and end of the ejection outlet cleaning operation, and therefore, the proper cleaning operation is assured.

Examples 5, 6 and 7 will be described in which a scattered ink receptor is provided to receive the ink scattered by the cleaning action. The use of the ink receptor is not limited to Example 4, but is usable with Examples 1–3.

EXAMPLE 5

Figure 17:
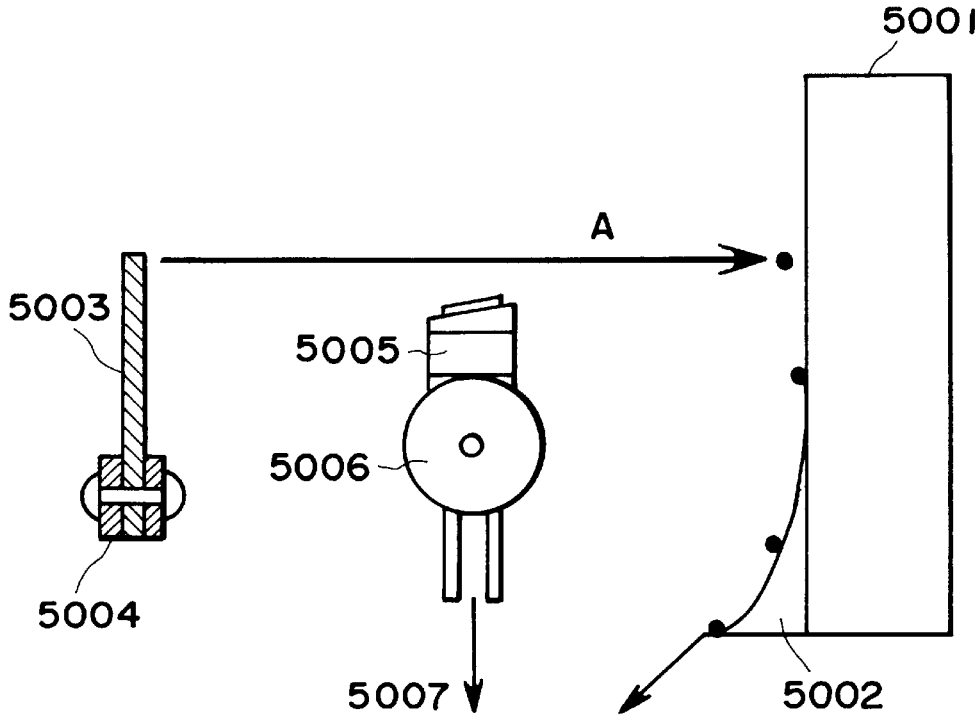
FIG. 17 shows a mechanism of wiping in an ink jet recording apparatus according to a fifth example.
Figure 18:
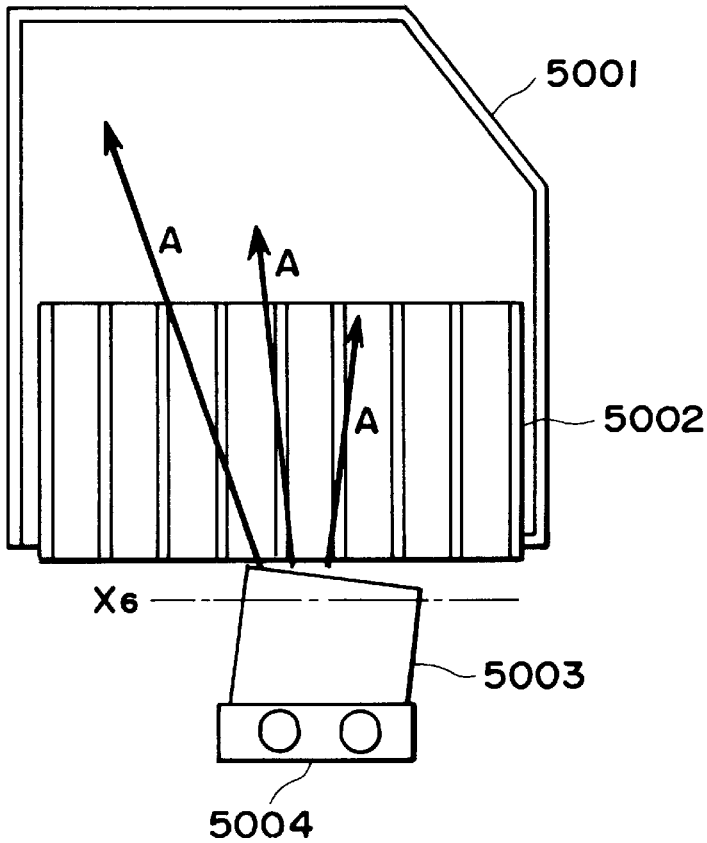
FIG. 18 shows a wiping structure in which ink scattering direction is controlled so that the scattered ink is received by an ink receptor.
Figure 19:
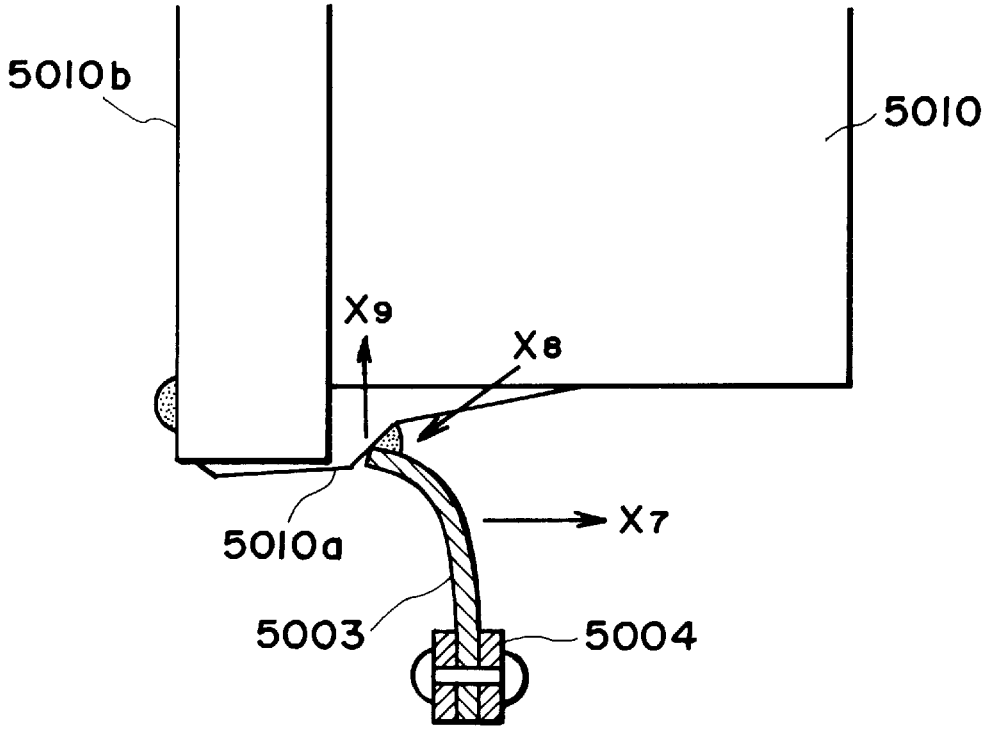
FIG. 19 shows a state in which a blade is in contact with the recording head.
Figure 20:
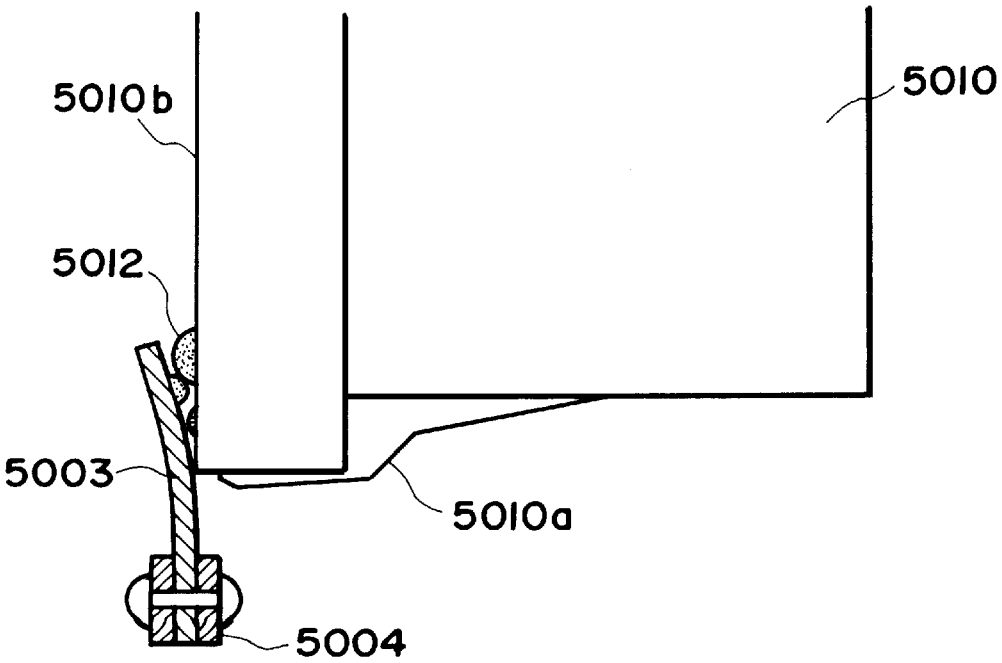
FIG. 20 shows a state in which a blade is in contact with an aluminum base plate of a recording head.

Referring to FIG. 17, there is shown a structure of Example 5, in which the wiping means comprises a blade 5003, a scattered ink receptor 5001. The surface (face) of the recording head 5010 (as shown in FIGS. 19 and 20) is wiped by a blade 5003 of urethane rubber or the like to scrape the ink of the surface, and the elastic force of the blade 5003 when it is away from the recording head 5010, is used throw the ink at the ink receptor 5001. The ink receptor 5001 is disposed in a direction of the ink scattering A, to prevent the ink scatters into the apparatus, thus preventing contamination of the inside of the main assembly and to maintain the clean apparatus and also to prevent users fingers from being contaminated during exchange of the recording head. The ink droplets received by the ink receptor 5001 flows down by the gravity into a residual ink collector 5007 along a residual ink slope 5002. The residual ink collected by the sucking recovery operation to the recording head using a cap 5005 and a cylinder pump 5006 disposed between the blade unit and the ink receptor 5001, is also discharged by the gravity from the cylinder pump 5006, and flows into the residual ink collector 5007. The residual ink receptor 5007 is not provided independently, but has a common inlet, and connected to an absorbing material. The absorbing material is disposed at a bottom surface or the like of the ink jet recording apparatus main assembly such that the space can be utilized efficiently. By using a single residual ink collector 5007, the cost increase is prevented, and the bulkiness of the apparatus is avoided by use of the bottom surface of the main assembly or the like. Referring to FIG. 18, the direction of the ink scattering is controlled by the elastic force of the blade 5003 to direct it into the ink receptor 5001. Designated by X6 is the contact surface of the recording head. In this example, the distance or amount of entering of the recording head 5010 (the distance from the contact surface) is different at the right and left sides, thus controlling the direction of the ink scattering. With increase of the contact degree to the recording head, the timing of departing from the recording head delays more, and when it is departed, it is contacted to the recording head only at one side having the larger entering amount. In such a wiping, the ink scatters toward the side of the delayed timing, and therefore, the directibility is given more, as compared with the ink scattering upon wiping with the same entering amount at the light and left sides. By doing so, the direction of the scattering ink is controlled, and the ink is received by the ink receptor 5001. In this example, the direction of the ink scattering is controlled by the entering amount of the blade into the recording head 5010, but the direction can be controlled by using different timing of contact at the left and right sides. Furthermore, the material of the blade may be changed at the left and right side. The thickness thereof may be different at the left and right. They may be tapered differently, or the hardness may be made different. They are effective to control the direction of the ink scattering. To control the ink scattering and to collect the scattered ink to the predetermined position, by the above-described means, is advantageous from the standpoint of cost as compared with electrostatic correction of the ink droplet, particularly the ink mist. Therefore, they are practically effective.

In FIG. 19, the blade 5003 is in contact with the recording head 5010. The blade 5003 contacted to the recording head 5010 is curved as shown in the Figure, and the elastic force by the blade, the ink droplets are scattered. The amount of blade deformation is determined on the basis of the material of the blade, the entering amount thereof to the recording head 5010, the free length of the blade or the like. The wiping nature for the recording head 5010 is dependent on the three factors, that is, the wiping speed X7, the contact angle θ (X8), the contact pressure X9. In this embodiment, the wiping speed is 150 mm/sec; the contact angle is approx. 30–50 degrees; and the contact pressure is approx. 8–10 g/cm. When the blade 5003 is away from the recording head 5010, the speed is reduced to one fifth to prevent too much scattering of the ink droplets to assure the ink to be received by the ink receptor 5001. By doing so, the sufficient wiping performance can be provided. However, the ink wiping performance is degraded if the contact with the blade 5003 is not proper due to dust or extremely high viscosity ink deposited, or when the ink scattering at the time of the previous wiping is not sufficient, and therefore, the ink remains. In order to stabilize the wiping performance at all times, the contact with the blade 5003 during the wiping is preferably properly effected with clean surface. In this example, the blade 5003 is rubbed with an aluminum base plate 5010*b* to scraping the ink sufficiently from the blade, and thereafter, the nozzle position of the recording head is wiped.

In FIG. 20, the blade 5003 is in contact with the aluminum base plate 5010*b*. The ink 5012 remaining on the blade 5003 is removed by the rubbing with the aluminum base plate 5010*b*, particularly by the edge thereof. The scraping performance of the aluminum base plate 5010*b* is enhanced by decrease of the remaining ink 5012. The number of recordable sheets is determined by the volume of the ink contained in the recording head 5010. Usually, 400–500 sheets can be prevented with approx. 7.5% print duty. Therefore, the scraping performance is maintained during the period for printing 400–500 sheets by the recording head 5010. When the recording head becomes empty, it is exchanged with a fresh recording head 5010, by which the aluminum base plate is also renewed. By the use of the blade cleaning structure as described above, the high durability wiping mechanism can be provided.

In this Example, the blade 5003 is rubbed with the aluminum base plate 5010*b*. This may be effected at any portion of the recording head if a certain degree of scraping performance is assured. By the exchange of the recording head, the scraping surface is cleaned, thus assuring the scraping performance.

As described in the foregoing, by setting the timing at which the blade is away at the time of the wiping operation, the ink scattering direction is controlled toward the ink receptor, by which the high durability blade cleaning mechanism is accomplished with low cost and small size. Thus, high performance wiping operation can be maintained at all times.

EXAMPLE 6

In this example, the ink receptor 6001 is movable together with a blade holder 6004.

The distance of travel of the scattered ink is different depending on the volume of the ink droplet, more particularly, the distance decreases with increase of the volume. Therefore, it would be possible that the ink droplet is deposited on various units in the recovery system disposed adjacent the blade unit. If, for example, the ink is deposited on the cap 6005, particularly the surface of the rib, the ink will be retransferred onto the recording head face with the result of reduction of the wiping performance even to the extent of improper ink ejection. If the deposited ink contains foreign matter such as paper dust or the like, or when the ink absorbs the foreign matter floating in the apparatus, the capping becomes insufficient with the result of the clogging of the nozzle or incapability of the sucking recovery operation due to the improper capping. In order to prevent the trouble, it is desirable that the ink receptor 6001 is disposed as close as possible to the blade unit.

Figure 21:
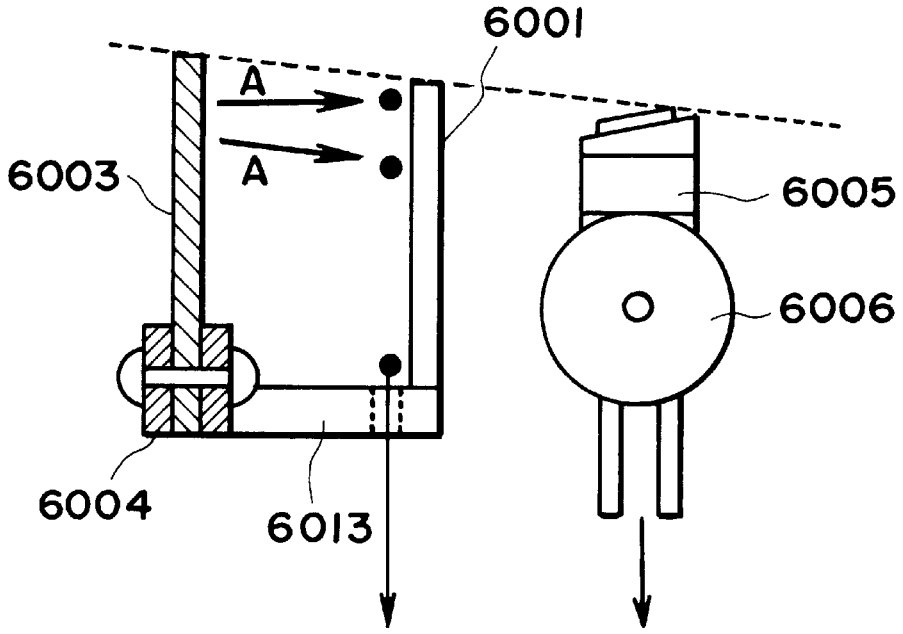
FIG. 21 shows a sixth embodiment in which the ink receptor is movable in interrelation with a blade holder.

FIG. 21 shows a wiping structure of this example. The scattered ink receptor 6001 is moved with the blade holder 6004, and the ink scattering resulting from the wiping is blocked by the ink receptor before it reaches another recovering unit part. The ink droplets coming to the ink receptor 6001 flows by the gravity through communication port between the blade holder 6004 and the ink receptor 6001. A residual ink collector 6007 is common for the residual ink resulted from the sucking recovery operation from the cylinder pump. The level of the scattered ink receptor 6001 is preferably as high as possible, but the contact with the recording head should be avoided. In this embodiment, the ink receptor is so disposed that an end of the ink receptor 6001 is on a tangent line connecting the end of the blade 6003 and the rib surface of the cap 6005 which is at the highest position in the other parts of the recovery unit. Assuming that the ink droplets travels linearly (A), the ink droplets traveling below the broken line in the Figure are all received by the ink receptor 6001, and the droplets traveling above the broken line go beyond the cap rib surface, and therefore, they are not deposited on the cap.

Figure 22:
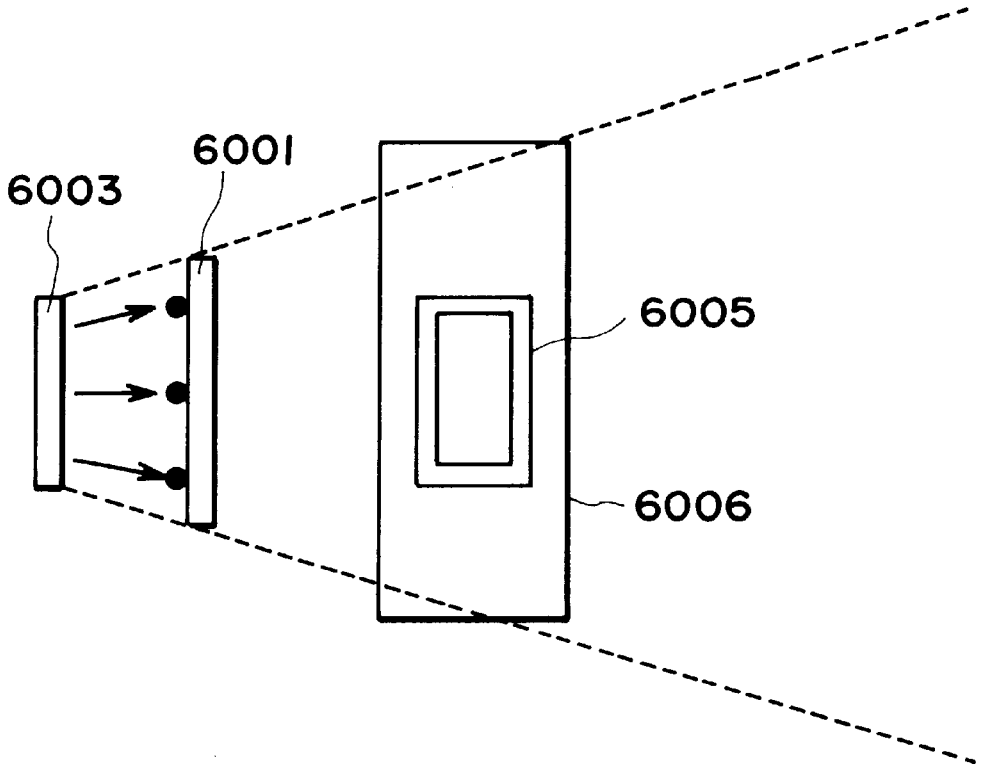
FIG. 22 is a top plan view illustrating the interrelated movement of the ink receptor with the blade holder.

FIG. 22 shows the position of the ink receptor 6001, as seen from the top. The scattering range (broken lines) as a result of the ink scattering direction control described in conjunction with Example 5, is assuredly covered by the ink receptor 6001. By such an ink receptor 6001, a zone in which the ink droplets do not scatter is provided, and the recovery unit such as the cap 6005 is disposed therein. The ink receptor 6001 is more effective if it is closer to the 6003, and a lateral width of the ink receptor 6001 may be smaller if it is closer thereto. However, the height of the ink receptor 6001 can not be extremely close to the blade 6003, as will be understood from FIG. 21. Therefore, the height of the ink receptor 6001 is selected in consideration of the balance among the height, position, distance from the recording head 6010 and the height of the recovery unit or the like. As described in the foregoing, since the ink receptor 6001 is moved in interrelation with the blade holder 6004, another parts of the recovery unit can be protected, and the ink deposition thereto can be avoided. The blade 6003 may be inclined toward the front to limit the ink scattering below the broken line in FIG. 21, by which all of the ink scattering can be accommodated by the ink receptor 6001. If the lateral area occupied by the blade unit can be extended, the frontward inclination of the blade is effective since the ink scattering above the blade can be controlled effectively.

This example is efficient and effective when it is used by itself, but it is more effective if combined with Example 5. It is a possible alternative that by the ink receptor disposed close to the blade unit, another part of the recovery unit is protected, and the other ink scattering is received by an ink receptor 6001 disposed behind as in Example 5.

In this example, the ink receptor 6001 is interrelatedly moved with the blade unit. If a separate control system is used, it is a possible alternative that the ink receptor 6001 is popped out only at the instance of the ink scattering. With this timing, the recording head 6010 is not above the ink receptor 6001, and therefore, the ink receptor 6010 may be disposed at a higher level, and therefore, it is possible to completely receive the scattered ink.

EXAMPLE 7

In this Example, the ink receptor 7001 is movable in interrelation with the cylinder pump 2006.

Figure 23:
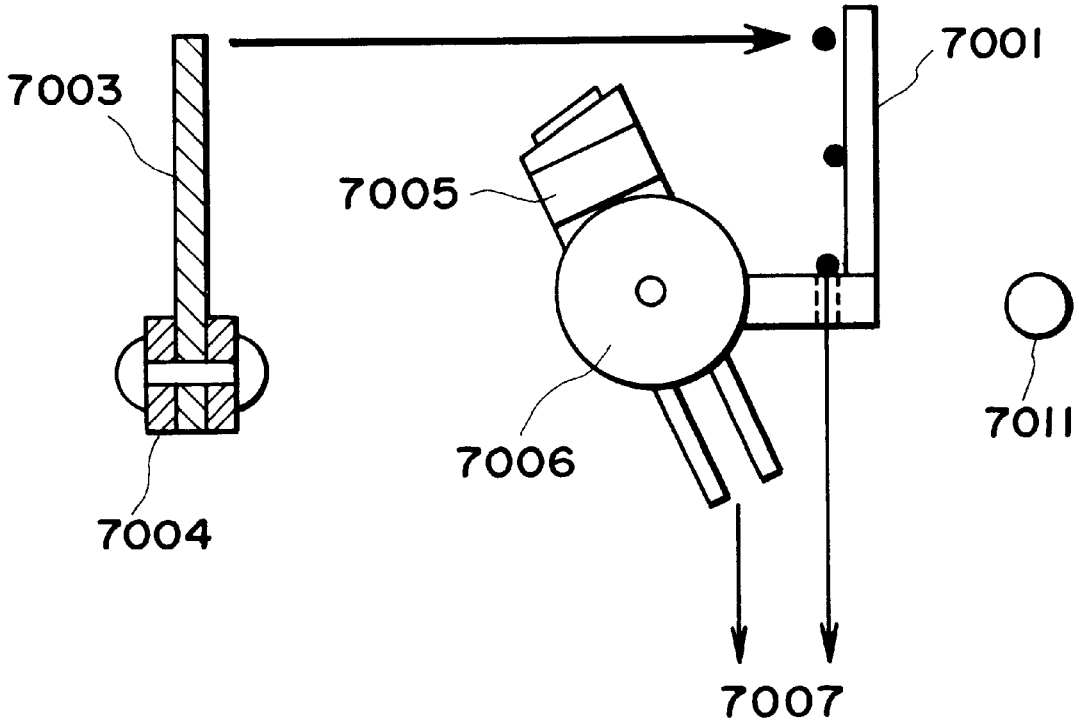
FIG. 23 shows a seventh embodiment in which the ink receptor is moved in interrelation with a cylinder pump.

In FIG. 23, the ink receptor 7001 is moved in interrelation with the cylinder pump 7006. In this example, the cylinder pump 7006 is moved by movement of the carriage. It rotates in accordance with the motion of the carriage, that is, the motion of the recording head, and the top cap 7005 caps the recording head 7010. In FIG. 23, when the capping is effected, the ink receptor 7001 lowers while being rotated into the state shown in the Figure at the instance of the wiping action. The ink droplets received by the ink receptor 7001 flows down by the gravity through a communication port into a residual ink collector 7007. The method of controlling the ink scattering direction is the same as in Examples 5 and 6.

This Example is particularly effective when the gap between the blade unit and the cylinder pump is small, and the ink receptor 7001 is to be closer to the blade 7003. If the ink receptor is made higher to assure the reception of the scattered ink, the radius of its rotation increases. By use of high polymer material such as polyethylene or the like, an abutment member 7011 may be provided within the radius of rotation of the ink receptor 7001, and the ink receptor 7001 may be flexed by the contact thereto, thus reducing the radius of rotation. As described in the foregoing, the ink scattering direction can be reduced, and therefore, the size of the main assembly and the size of the recovery unit in the carriage movement direction can be effectively reduced.

The material of the ink receptor used in Examples 5, 6 and 7, will be described.

The ink receptor 5001, 6001 and 7001 may be molded, and the molding material is sufficiently advantageous. However, the consideration should be paid to the flow of the ink to the residual ink collector. In addition, the rebound from the ink receptor should be considered. In Examples 5, 6 and 7, the improvement is possible. In these examples, the ink receptor 5001, 6001 or 7001 is made of ink absorbing material. The ink received by the absorbing material is absorbed by the material, and is retained there for a short period of time. However, it gradually lowers the gravity. The rebound of the ink can be prevented on the surface of the ink receptor as long as it can absorb the ink to a certain extent. In this case, the absorbing material is not required to have a high ink retaining capacity, but it is sufficient if it can temporarily retain the ink. A thin ink absorbing material is stuck on the surface of the ink receptor, and therefore, it will not substantially increase the cost.

By combination of Examples 5, 6 and 7, more advantageous effects are accomplished.

According to Examples 5, 6 and 7, the timing at which the blade is away from the recording head during the wiping operation is controlled, by which the ink scattering direction is controlled, and the scattered ink is received by the ink receptor. By doing so, the low cost and small size structure is accomplished, while highly durability cleaning performance is accomplished with high wiping performance.

The present invention is usable with any ink jet apparatus, such as those using electromechanical converter such as piezoelectric element, but is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals.

By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy.

Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A wiping mechanism for wiping an ink ejection side surface of an ink jet head for effecting recording by ejection of ink through ejection outlets, said mechanism comprising:

a wiper for wiping the ejection side surface; and changing means for changing a positional relation of said wiper and the ink jet head along a path of reciprocating movement of the ink let head but outside a recording area of the ink let head between a non-wiping position and a wiping position, wherein the changing means cooperates with a carriage for moving the ink jet head relative to a recording medium so that the wiper is in the non-wiping position when the ink let head has been turned by the carriage at a first point outside the recording area so that motion of the ink let head is not impeded by the wiper during image recording, and to cause the wiper to change from the non-wiping position to the wiping position when the ink let head is turned by the carriage at a second point further away from the recording area than the first point, so that wiping of the election side surface can be effected.

2. A mechanism according to claim 1, further comprising a member supporting said wiper, wherein said wiper is placed into the non-wiping position by contact of the carriage with a cam provided on said member, the non-wiping relation being maintained by engagement with a latching member.

3. A mechanism according to claim 2, wherein said wiper disengages from said latching member in accordance with movement of the carriage to release the non-wiping relation.

4. A mechanism according to claim 1, wherein said wiper is operative when the carriage is moved from the non-recording region to a recording region wherein recording is performed.

5. A mechanism according to claim 1, wherein said wiper moves at a predetermined wiping speed for a portion of said ejection side surface having the ejection outlets, and the wiping speed is changed in other portions.

6. A mechanism according to claim 1, wherein said wiper member moves at a predetermined wiping speed in a portion of the ejection side surface having the ejection outlets, and the wiping speed is decreased after wiping of the portion.

7. A mechanism according to claim 1, wherein said wiper member moves at a predetermined wiping speed for a portion of the ejection side surface having the ejection outlets, and the wiping speed is increased after the wiping of the portion.

8. A mechanism according to claim 1, wherein an ink receptor is provided for receiving ink scattered by a wiping operation of said wiper.

9. A mechanism according to claim 1, wherein a direction of ink scattering resulting from a wiping operation of said wiper is controlled, and an ink receptor is disposed for receiving ink scattered by the wiping operation.

10. A mechanism according to any one of claims 1–9, wherein the ink jet head is provided with an electrothermal transducer for producing thermal energy for ejecting the ink.

11. An ink jet apparatus for ejecting ink through ejection outlets to effect recording on a recording material, said apparatus comprising:

a carriage for carrying an ink jet head, said carriage being movable relative to the recording material;

a wiper for wiping an ejection side surface of the ink jet head having the ink ejection outlets; and changing means for changing a positional relation of said wiper and the ink jet head along a path of reciprocating movement of the ink jet head but outside a recording area of the ink let head between a non-wiping position and a wiping position, wherein the changing means cooperates with the carriage so that the wiper is in the non-wiping position when the ink let head has been turned by the carriage at a first point outside the recording area so that motion of the ink jet head is not impeded by the wiper during image recording, and to cause the wiper to change from the non-wiping position to the wiping position when the ink let head is turned by the carriage at a second point further away from the recording area than the first point, so that wiping of the election side surface can be effected.

12. An apparatus according to claim 11, further comprising a member supporting said wiper, wherein said wiper is placed into the non-wiring position by contact of said carriage with a cam provided on said member, the non-wiping relation being maintained by engagement with a latching member of said apparatus.

13. An apparatus according to claim 12, wherein said wiper disengages from said latching member in accordance with movement of the carriage to release the non-wiping relation.

14. An apparatus according to claim 11, wherein said wiper is operated when said carriage is moved from a non-recording region to a recording region.

15. An apparatus according to claim 11, wherein said wiper moves at a predetermined wiping speed for a portion of said ejection side surface having the ejection outlets, and the wiping speed is changed in the other portions.

16. An apparatus according to claim 11, wherein said wiper member moves at a predetermined wiping speed in a portion of the ejection side surface having the ejection outlets, and the wiping speed is decreased after wiping of the portion.

17. An apparatus according to claim 11, wherein said wiper moves at a predetermined wiping speed for a portion of the ejection side surface having the ejection outlets, and the wiping speed is increased after wiping of the portion.

18. An apparatus according to claim 11, wherein an ink receptor is provided for receiving ink scattered by a wiping operation of said wiper.

19. An apparatus according to claim 11, wherein a direction of ink scattering resulting from a wiping operation of said wiper is controlled, and an ink receptor is disposed for receiving ink scattered by the wiping operation.

20. An apparatus according to any one of claims 11–19, wherein the ink jet head is provided with an electrothermal transducer for producing thermal energy for ejecting the ink.

21. A method for wiping an ejection side surface of an ink jet apparatus for effecting recording on a recording material by ejection of ink through ink ejection outlets formed in said ejection side surface, said method comprising the steps of:

changing a positional relation of said wiper and the ink jet head along a path of reciprocating movement of the ink jet head but outside a recording area of the ink jet head between a non-wiping position and a wiping position, wherein, in said changing step, a carriage moves the ink jet head relative to the recording material so that the wiper is in the non-wiping position when the ink jet head has been turned by the carriage at a first point outside the recording area so that motion of the ink jet head is not impeded by the wiper during image recording, and to cause the wiper to change from the non-wiping position to the wiping position when the ink jet head is turned by the carriage at a second point further away from the recording area than the first point, so that wiping of the ejection side surface can be effected.

22. An ink jet apparatus for recording on a recording medium by ejecting ink from ejection outlets at an ink ejection surface of an ink jet head, the apparatus comprising:

a carriage for reciprocating the ink jet head across a recording area; and a wiping mechanism for wiping the ink ejection surface, said mechanism including a wiper and changing means for changing a position of the wiper between a wiping position along a path of reciprocating movement of the ink jet head but outside the recording area of the ink jet head and a non-wiping position in which wiping of the ink ejection surface is not effected, wherein the changing means cooperates with the carriage so that the wiper is in the non-wiping position when the ink jet head has been turned by the carriage at a first point outside the recording area so that motion of the ink jet head is not impeded by the wiping mechanism during image recording, and to cause the wiper to change from the non-wiping position to the wiping position when the ink jet head is turned by the carriage at a second point further away from the recording area than the first point, so that wiping of the ink ejection surface can be effected.

23. A wiping mechanism for wiping an ink ejection side surface of an ink jet head for effecting recording by ejection of ink through ejection outlets, said mechanism comprising:

a wiper for wiping the ejection side surface; and changing means for changing a positional relation of said wiper and the ink jet head along a path of reciprocating movement of the ink jet head but outside a recording area of the ink jet head between a non-wiping position and a wiping position, wherein the changing means cooperates with a carriage for moving the ink jet head relative to a recording medium so that the wiper is in the non-wiping position when the ink jet head has been turned by the carriage at a point outside the recording area so that motion of the ink jet head is not impeded by the wiper during image recording.

24. A mechanism according to claim 23, further comprising a member supporting said wiper, wherein said wiper is placed into the non-wiping position by contact of the carriage with a cam provided on said member, the non-wiping relation being maintained by engagement with a latching member.

25. A mechanism according to claim 24, wherein said wiper disengages from said latching member in accordance with movement of the carriage to release the non-wiping relation.

26. A mechanism according to claim 23, wherein said wiper is operative when the carriage is moved from the non-recording region to a recording region wherein recording is performed.

27. A mechanism according to claim 23, wherein said wiper moves at a predetermined wiping speed for a portion of said ejection side surface having the ejection outlets, and the wiping speed is changed in other portions.

28. A mechanism according to claim 23, wherein said wiper member moves at a predetermined wiping speed in a portion of the ejection side surface having the ejection outlets, and the wiping speed is decreased after wiping of the portion.

29. A mechanism according to claim 23, wherein said wiper member moves at a predetermined wiping speed for a portion of the ejection side surface having the ejection outlets, and the wiping speed is increased after the wiping of the portion.

30. A mechanism according to claim 23, wherein an ink receptor is provided for receiving ink scattered by a wiping operation of said wiper.

31. A mechanism according to claim 23, wherein a direction of ink scattering resulting from a wiping operation of said wiper is controlled, and an ink receptor is disposed for receiving ink scattered by the wiping operation.

32. A mechanism according to any one of claims 23 to 31, wherein the ink jet head is provided with an electrothermal transducer for producing thermal energy for ejecting the ink.

33. An ink jet apparatus for ejecting ink through ejection outlets to effect recording on a recording material, said apparatus comprising:

a carriage for carrying an ink jet head, said carriage being movable relative to the recording material;

a wiper for wiping an ejection side surface of the ink jet head having the ink ejection outlets; and changing means for changing a positional relation of said wiper and the ink jet head along a path of reciprocating movement of the ink jet head but outside a recording area of the ink jet head between a non-wiping position and a wiping position, wherein the changing means cooperates with the carriage so that the wiper is in the non-wiping position when the ink jet head has been turned by the carriage at a point outside the recording area so that motion of the ink jet head is not impeded by the wiper during image recording.

34. An apparatus according to claim 33, further comprising a member supporting said wiper, wherein said wiper is placed into the non-wiping position by contact of said carriage with a cam provided on said member supporting said wiper, the non-wiping relation being maintained by engagement with a latching member of said apparatus.

35. An apparatus according to claim 34, wherein said wiper disengages from said latching member in accordance with movement of the carriage to release the non-wiping relation.

36. An apparatus according to claim 33, wherein said wiper is operated when said carriage is moved from a non-recording region to a recording region.

37. An apparatus according to claim 33, wherein said wiper moves at a predetermined wiping speed for a portion of said ejection side surface having the ejection outlets, and the wiping speed is changed in the other portions.

38. An apparatus according to claim 33, wherein said wiper member moves at a predetermined wiping speed in a portion of the ejection side surface having the ejection outlets, and the wiping speed is decreased after wiping of the portion.

39. An apparatus according to claim 33, wherein said wiper moves at a predetermined wiping speed for a portion of the ejection side surface having the ejection outlets, and the wiping speed is increased after wiping of the portion.

40. An apparatus according to claim 33, wherein an ink receptor is provided for receiving ink scattered by a wiping operation of said wiper.

41. An apparatus according to claim 33, wherein a direction of ink scattering resulting from a wiping operation of said wiper is controlled, and an ink receptor is disposed for receiving ink scattered by the wiping operation.

42. An apparatus according to any one of claims 33 to 41, wherein the ink jet head is provided with an electrothermal transducer for producing thermal energy for ejecting the ink.

43. A method for wiping an ejection side surface of an ink jet apparatus for effecting recording on a recording material by ejection of ink through ink ejection outlets formed in said ejection side surface, said method comprising the steps of:

changing a positional relation of said wiper and the ink jet head along a path of reciprocating movement of the ink jet head but outside a recording area of the ink jet head between a non-wiping position and a wiping position, wherein, in said changing step, a carriage moves the ink jet head relative to the recording material so that the wiper is in the non-wiping position when the ink jet head has been turned by the carriage at a point outside the recording area so that motion of the ink jet head is not impeded by the wiper during image recording.

44. An ink jet apparatus for recording on a recording medium by ejecting ink from ejection outlets at an ink ejection surface of an ink jet head, the apparatus comprising:

a carriage for reciprocating the ink jet head across a recording area; and a wiping mechanism for wiping the ink ejection surface, said mechanism including a wiper and changing means for changing a position of the wiper between a wiping position along a path of reciprocating movement of the ink jet head but outside the recording area of the ink jet head and a non-wiping position in which wiping of the ink ejection surface is not effected, wherein the changing means cooperates with the carriage so that the wiper is in the non-wiping position when the ink jet head has been turned by the carriage at a point outside the recording area so that motion of the ink jet head is not impeded by the wiping mechanism during image recording.

* * * * *

UNITED STATES PATENT AND TRADEMARK OFFICE

CERTIFICATE OF CORRECTION

PATENT NO. : 6,109,725
DATED : August 29, 2000
INVENTOR(S) : Saikawa et al.

It is certified that error appears in the above-identified patent and that said Letters Patent is hereby corrected as shown below:

Title page,
The following should be inserted where appropriate:

-- [*] Notice: This patent issued on a continued prosecution application filed under 37 CFR 1.53 (d), and is subject to the twenty year patent term provisions of 35 U.S.C. 154 (a) (2) . --

Under FOREIGN PATENT DOCUMENTS:
"2235761" should read -- 2-235761 --;
"3047754" should read -- 3-047754 --;
"3073352" should read -- 3-073352 --;
"3274164" should read -- 3-274164 --;
"3281254" should read -- 3-281254 --; and
"4090358" should read -- 4-090358 --.

Column 2,
Line 26, "Figure. The" should read -- Figure. ¶The --.

Column 3,
Line 51, "to" should be deleted; and
Line 62, "8(b)" should read -- 8(b) illustrate --.

Column 5,
Line 22, "illustrates" should read -- illustrate --.

Column 8,
Line 22, "throw" should read -- to throw --;
Line 27, "users" should read -- users' --;
Line 38, "connected" should read -- is connected --; and
Line 66, "side." should read -- sides. --.

Column 9,
Line 34, "scraping" should read -- scrape --.

Column 10,
Line 38, "travels" should read -- travel --; and
Line 53, "can not" should read -- cannot --.

UNITED STATES PATENT AND TRADEMARK OFFICE

CERTIFICATE OF CORRECTION

PATENT NO. : 6,109,725
DATED : August 29, 2000
INVENTOR(S) : Saikawa et al.

It is certified that error appears in the above-identified patent and that said Letters Patent is hereby corrected as shown below:

Column 12,
Line 4, "is" should read -- are --; and
Line 30, "the the" should read -- the --.

Column 13,
Lines 36, 37, 42, 44 and 47, "let" should read -- jet --; and
Line 49, "election" should read -- ejection --.

Column 14,
Lines 29, 33 and 38, "let" should read -- jet --;
Line 40, "election" should read -- ejection --; and
Line 45, "member," should read -- member supporting said wiper, --.

Column 15,
Line 14, "steps" should read -- step --.

Column 17,
Line 30, "steps" should read -- step --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*